US005463952A

United States Patent [19]

Kawasumi et al.

[11] Patent Number: 5,463,952

[45] Date of Patent: Nov. 7, 1995

[54] PLANOGRAPHIC PRINTING PLATE WITH ELECTROLYTICALLY ROUGHENED DESIGN PATTERN ON A BACK SURFACE THEREOF

[75] Inventors: Seiji Kawasumi; Yuzo Inukai, both of Shizuoka, Japan

[73] Assignee: Fuji Photo Film Co., Ltd., Kanagawa, Japan

[21] Appl. No.: 222,914

[22] Filed: Apr. 5, 1994

[30] Foreign Application Priority Data

Apr. 5, 1993 [JP] Japan ..... 5-100118

[51] Int. Cl.[6] ..... B41N 1/08

[52] U.S. Cl. ..... 101/454; 101/456; 101/457; 101/395; 205/127; 205/921

[58] Field of Search ..... 101/453–462, 101/463.1, 395; 205/127, 921

[56] References Cited

U.S. PATENT DOCUMENTS

| | | | |
|---|---|---|---|
| 4,018,152 | 4/1977 | Heidrich | 101/41 |
| 4,390,407 | 6/1983 | Mori et al. | 204/206 |
| 4,396,468 | 8/1983 | Walls | 205/921 |
| 4,468,295 | 8/1984 | Pliefke | 101/459 |
| 4,502,925 | 3/1985 | Walls | 101/459 |

FOREIGN PATENT DOCUMENTS

| | | | |
|---|---|---|---|
| 123202 | 10/1978 | Japan | 101/459 |
| 134502 | 11/1978 | Japan | 101/459 |
| 1586 | 1/1987 | Japan | 101/453 |

*Primary Examiner*—Stephen Funk

*Attorney, Agent, or Firm*—Sughrue, Mion, Zinn, Macpeak & Seas

[57] ABSTRACT

A planographic printing plate in which a design pattern is realized in a part of the back surface of a support for the planographic printing plate without any adverse influence on a photosensitive resin layer on the front surface thereof. After an aluminum support with a thickness of 0.24 mm is cleaned by degreasing and etching, an electrolytic aqueous solution is prepared to contain the nitric acid concentration of 10 g/l and the aluminum ion concentration of 7 g/l. In an electrolytic treatment cell 5, the back surface of the aluminum support is arranged so as to be faced to an electrode. A 1 mm-thick masking plate formed of an insulating material punched to provided openings with arbitrary shapes is brought into close contact with the back surface of the aluminum support so that the back surface of the aluminum support is covered with the masking plate. A carbon plate with a thickness of 50 mm is used as the electrode. Further, the electrolytic aqueous solution is supplied from a blowout nozzle toward the masking plate at a flow rate of 50 m/min. The electrode and the aluminum support are connected to an electric source through a cable so that the aluminum support 7 was partially roughened electrochemically.

5 Claims, 2 Drawing Sheets

PLANOGRAPHIC PRINTING PLATE WITH ELECTROLYTICALLY ROUGHENED DESIGN PATTERN ON A BACK SURFACE THEREOF

BACKGROUND OF THE INVENTION a) Field of the Invention

The present invention relates to a planographic printing plate and a method of manufacturing a support therefor, and particularly to a planographic printing plate in which a part of a surface (back surface) not subjected to roughening treatment for application of a photosensitive resin layer in a planographic printing plate is roughened electrochemically to obtain a rough surface having an arbitrary shape (for example, a design pattern), and a method of manufacturing a support therefor.

b) Description of the Related Art

A planographic printing plate is mainly composed of an aluminum or aluminum alloy support (hereinafter simply referred to as an "aluminum plate") and a photosensitive resin layer. Heretofore, a so-called graining treatment for roughening the entire surface of a support to be brought into close contact with a photosensitive resin layer is carried out in order to make the adhesion between the support and the photosensitive resin layer good and to provide water retentivity to a non-image portion.

As specific means for this graining treatment, there are mechanical graining methods such as a sandblasting method, a ball graining method, a brush graining method using a nylon brush and an abrasive agent/water slurry, a honing graining method of blowing an abrasive agent/water slurry onto a surface of a support at a high pressure, etc., and chemical graining methods for roughening a surface with an etching agent formed of an alkaline agent or an acidic agent or a mixture thereof. There are further known electrochemical graining methods described in Japanese Patent Unexamined Publication Nos. Sho-52-58602, Sho-52-152302, Sho-54-85802, Sho-55-158298, Sho-58-120531, Sho-60-147394, Sho-56-28898, Sho-60-190392, Hei-1-5589, Hei-1-280590, Hei-1-118489, Hei-1-141094, Hei-1-148592, Hei-1-178496, Hei-1-188395, Hei-1-154797, Hei-2-235794, Hei-3-260100 and Hei-3-253600, electrochemical graining methods using a sinusoidal waveform AC electric source as described in Japanese Patent Unexamined Publication No. Sho-48-28123 and the specification of British Patent No. 896563, electrochemical graining methods using special waveform as described in Japanese Patent Unexamined Publication No. Sho-52-58602, methods using a mechanical graining method and an electrochemical graining method in combination as described in Japanese patent Unexamined Publication Nos. Sho-54-123204 and Sho-54-63902, a method using a mechanical graining method and a chemical graining method using a saturated aqueous solution of aluminum salt of mineral acid in combination as described in Japanese Patent Unexamined Publication No. Sho-56-55261, and so on.

Among the aforementioned various roughening methods, electrochemical roughening methods are known as methods in which: the shape of the resulting rough surface is controlled easily; a fine rough surface is obtained; and production equipment is simplified.

Because a roughened aluminum surface is soft in itself so that the surface abrades easily, an oxide film is formed by anodic oxidation and then a photosensitive resin layer is provided thereon. The thus treated surface of the aluminum plate is hard and excellent in durability against abrasion, so that the surface exhibits good hydrophilic property, water retentivity and property of adhesion to the photosensitive resin layer.

On the other hand, surface treating methods for building materials, name plates, etc. formed of aluminum are known widely and generally. As specific means for these treating methods, there is, for example, a treating method for manufacturing a pattern in an aluminum surface by electrolytic treatment in a de-smut solution as described in Japanese Patent Postexamination Publication No. Sho-60-15717, a treating method for forming a longitudinally striped film by the action of bubbles produced by application of AC electrolysis in an electrolytic bath after (mechanical, chemical or electrochemical) roughening of an aluminum surface as described in Japanese Patent Postexamination Publication No. Sho-60-11118, a treating method of the steps of: applying a resin solution onto a surface of a plate such as a name plate formed of a metal (for example, aluminum) in the form of a pattern such as a character pattern; drying the resin solution to form a protection film on the surface; and forming a pattern such as a character pattern by removing the protection film after electrolytic polishing in an electrolytic bath, as described in Japanese Patent Postexamination Publication No. Sho-61-54120, a treating method of the steps of: applying anodic oxide coating after treatment (resin treatment, mechanical/chemical polishing, hair-line/sand blasting, etc.) of aluminum; carrying out printing by using printing ink excellent in non-electroconductivity after drying; drying and hardening the printing ink by an anealing means; and forming a pattern such as a character pattern by electrodeposition coating to these surfaces, as described in Japanese Patent Postexamination Publication No. Hei-2-3718, a treating method of the steps of: supplying a pattern-producing matter (such as an oil dye, etc.) obtained by mixing/dispersing a powdered magnetic substance onto a liquid surface of a water bath in advance; making magnetic force produced by an electromagnet act on the magnetic substance in the pattern-producing matter to thereby reveal a predetermined pattern in the pattern-producing matter on the liquid; and making the predetermined pattern deposit onto an aluminum material subjected to anodic oxidation (inclusive of coloring treatment) after pre-treatment (degreasing/cleaning, etching, de-smutting, etc.) to thereby produce a pattern on the aluminum material, as described in Japanese Patent Postexamination Publication No. Sho-59-50198, and so on.

Further, surface treating methods for metals other than aluminum are known widely and generally. As specific means for these treating methods, there is, for example, a treating method adapted to the case of copper and comprising the steps of: marking a copper plate with a pattern such as a character pattern by a marking material having property of adhesion to the copper plate after pre-treatment (electrolytic film forming treatment, electrochemical film forming treatment, chemical treatment, soaking treatment) of the copper plate; forming a resist film not having a property of adhesion to the marking material but having a property of adhesion to the copper plate, on the other, not-marked portion of the copper plate; applying plating to the marked portion of the copper plate after removing only the marking material; and removing the resist film to thereby form a pattern such as a character pattern, as described in Japanese Patent Postexamination Publication No. Sho-60-41154, a treating method adapted to the case of stainless steel and comprising the steps of: printing a not-patterned portion of a stainless steel article with acid-resisting ink by screen printing; making a patterned portion corrode by etching to thereby form a cavity portion; and carrying out plating with the stainless steel article as an anode and gold, silver, copper, etc. as a cathode in the condition in which the bottom of the cavity portion is polished electrolytically and an acid-resisting solution is applied onto the portion other than the cavity portion to thereby form a plated layer of a metal such as gold, silver, copper, etc. on the bottom of the cavity portion, as described in Japanese Patent Unexamined Publication No. Sho-50-56334, treating methods adapted to the case of stainless steel and for forming a color pattern on a stainless-clad aluminum plate, as described in Japanese Patent Postexamination Publication Nos. Sho-53-39869 and Sho-56-10999, a treating method adapted to the case of stainless steel and for carrying out coloring treatment (coloring in a sulfuric acid-chromic acid solution, hardening of an oxide film) after applying mechanical patterning treatment (scribing, pressing with a jig having a pattern, drawing a pattern with a sharp knife, embossing treatment, etc.) to the back surface of a stainless steel plate, as described in Japanese Patent Unexamined Publication No. Hei-2-307629, and so on.

On the other hand, the entire surface having no photosensitive resin layer (back surface), of a planographic printing plate may be subjected to surface treatment. As specific means for this treating method, there is a method of treating the surface with an aqueous solution of alkali-metal silicate as described in Japanese Patent Unexamined Publication No. Hei-3-90388, a method of applying paint containing a surface toughening agent dispersed therein or carrying out mechanical treatment such as ball graining, honing graining, brush graining, etc. or carrying out powdering directly by using powder, as described in Japanese Patent Unexamined Publication No. Sho-62-1586, a method of carrying out heat fusion after applying resin particles substantially uniformly as described in Japanese Patent Unexamined Publication No. Hei-3-249652, a method of producing an embossed pattern on the whole by pressing an embossing roller from the back surface, as described in Japanese Postexamination Publication No. Sho-55-237, and so on.

Further, methods of realizing a design pattern in a portion of the back surface of a support for a planographic printing plate include an ink-jet method, a printing method, and so on.

In these methods, however, a portion of ink deposited by printing becomes swollen. Accordingly, these methods have not only a defect that the resulting printing plate is stuck to the photosensitive resin layer in the case of winding or stacking, but also a defect that ink is eluted at the time of development. In addition, these methods have a defect that equipmental cost required for preventing the elution of ink becomes enormous if the elution of ink is prevented by use of (UV- or thermo-)setting ink.

Further, there is a method of sticking a roller or plate having a realized design pattern to the back surface of a support for planographic printing plate. This method, however, has not only a defect that a design pattern portion of the roller or plate abrades but a defect that the plane flatness of the support is spoiled to make it difficult to attain the uniform characteristic of the coated layer in the case where a photosensitive resin layer is provided because a compressed portion of the support becomes swollen.

SUMMARY OF THE INVENTION

An object of the present invention is to solve the aforementioned problems, that is, to provide a planographic printing plate in which not only a design pattern realized in a part of the back surface of a support for the planographic printing plate has no bad influence on a photosensitive resin layer but it is possible to maintain high-grade characteristic of the design pattern and improve the added value thereof even in the case where developing treatment is completed.

The foregoing objects of the present invention are achieved by:

(1) A planographic printing plate having a layer of photosensitive resin provided on an aluminum support, characterized in that the planographic printing plate has a rough surface of a desired arbitrary shape in a surface in which no photosensitive resin is provided.

(2) A method of manufacturing a support for the planographic printing plate by using an aluminum plate, characterized in that a surface of the support in which no layer of photosensitive resin is provided is covered with a plate of insulating material punched into a desired arbitrary shape, and then a current is applied to the support in an electrolytic aqueous solution through a punched surface of the insulating material to thereby perform roughening to form a rough surface of a desired arbitrary shape in the surface of the support in which no photosensitive resin is provided.

(3) A method of manufacturing a support for the planographic printing plate according to the above item (2), characterized in that the roughening is carried out before or after the whole of a surface of the support in which the photosensitive resin layer is provided is roughened electrochemically.

DETAILED DESCRIPTION OF THE INVENTION

Figure 1:
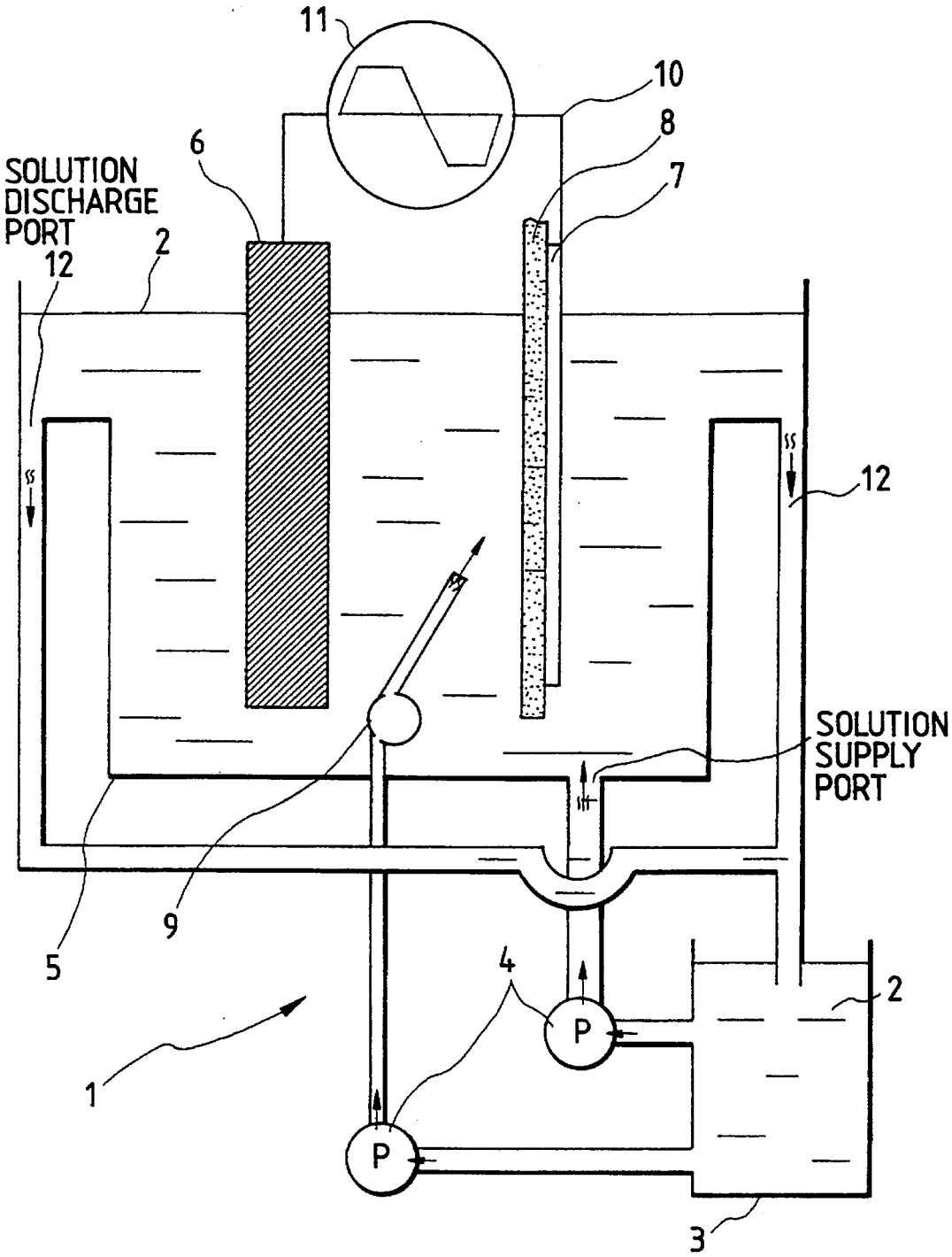
FIG. 1 is a schematic side view of an electrolytic treatment apparatus as an embodiment of the electrochemical roughening step of the support for the planographic printing plate according to the present invention.

The present invention will be described below in detail.

The aluminum support for the planographic printing plate used in the present invention can be selected from various aluminum plates such as a plate formed of a JISA1050 material, a plate formed of a JISA1100 material, a plate formed of a JISA3003 material, a plate formed of a JISA3103 material, a plate formed of a JISA5005 material, etc. A surface (front surface) provided with the photosensitive resin layer, however, has an influence on the characteristic of the printing plate. With respect to selection of the material in the case of aluminum uniform in its front and back surfaces, it is generally necessary that an optimum material is selected in accordance with the (mechanical, chemical or electrochemical) surface roughening method so that a preference is given to the surface (front surface) being provided with the photosensitive resin layer even in the case where a design pattern is realized in the back surface of the aluminum support.

In the case of an aluminum support having its front and back surfaces formed of different components, however, the aforementioned rule cannot be applied but optimum materials can be selected in accordance with treating methods used for the respective surfaces (front and back surfaces).

With respect to the aforementioned aluminum support, pre-treatment for removing rolling oil from the front and back surfaces thereof or for revealing clean aluminum surfaces, or mechanical graining treatments for increasing the surface areas of the surfaces, may be carried out if necessary before the electrochemical surface roughening treatment. The electrochemical surface roughening treatment according to the present invention is applied to the surface (front surface) being provided with the photosensitive resin layer and the back surface respectively. For the pre-treatment for removing rolling oil from the front and back surfaces, an organic solvent such as trichlene, etc., a surface active agent or soda silicate is widely used. For the pre-treatment for revealing clean aluminum surfaces, an alkali-etching agent such as sodium hydroxide, potassium hydroxide, etc. is widely used. For the mechanical graining treatment for increasing the surface areas of the surfaces, a ball graining method, a nylon brush method, etc. is widely used.

In the succeeding electrochemical surface roughening treatment, treatment of the surface (front surface) being provided with the photosensitive resin layer is carried out if necessary. For electrochemical treatment of the back surface, an AC electric waveform is used. Examples of the AC electric waveform include a three-phase sinusoidal AC waveform, and other alternating waveforms such as a rectangular waveform, a trapezoidal waveform, etc.

In the case where the surface (front surface) being provided with the photosensitive resin layer is to be subjected to electrochemical surface roughening treatment, the treatment can be carried out before or after the treatment of the back surface but it is preferable that the treatment is carried out after the treatment of the back surface.

Further, the electrochemical surface toughening treatment of the front surface and the electrochemical surface roughening treatment of the back surface which are started from the pre-treatment and/or the mechanical graining treatment can be carried out separately but it is preferable that these treatments are carried out continuously.

Because the present invention relates to electrochemical surface roughening of the back surface, the invention will be described hereinafter with the back surface as the main subject.

As the electrolytic aqueous solution, an acidic aqueous solution containing hydrochloric acid, nitric acid, hydrofluoric acid, boric acid or tartaric acid as an essential component or an acidic aqueous solution containing a mixture of two or more members selected from these acids is preferably used. A solution containing hydrochloric acid or nitric acid as a main component is preferred. The electrolytic aqueous solutions may comprise conventional solutions. The electrolyte concentration thereof is preferably selected to be in a range of from about 0.5% by weight to about 5.0% by weight. If necessary, anti-corrosion agents (or stabilizing agents) such as nitrates, monoamines, diamines, aldehydes, phosphoric acid, chromic acid, boric acid, ammonium salt, aluminum salt, carbonates, etc. can be added to these electrolytic aqueous solutions.

A method of supplying an alternating current to an aluminum support in a nitric acid electrolytic aqueous solution to make the quantity of anodic electricity (QA) larger than the quantity of cathodic electricity (QC) as described in the specification of U.S. Pat. No. 4,087,341, a method using an electrochemical surface roughening treatment apparatus in which a circuit for an auxiliary counter electrode is connected in parallel to a circuit connected to a main counter electrode for an aluminum support and in which a diode for controlling the flow of an anode current in the main counter electrode or a mechanism fulfilling such a diode function is provided in the circuit for the auxiliary counter electrode, as described in Japanese Patent Postexamination Publication No. Sho-61-48596, and so on, may be employed in the present invention.

The voltage to be applied between electrodes is selected to be preferably in a range of from about 1 V to about 200 V, more preferably, in a range of from 2 V to 100 V. The current density is selected to be preferably in a range of from about 3 A/dm$^2$ to about 300 A/dm$^2$, more preferably, in a range of from 3 A/dm$^2$ to 250 A/dm$^2$. The quantity of electricity is selected to be preferably in a range of from about 5 C/dm$^2$ to about 500 C/dm$^2$, more preferably, in a range of from 5 C/dm$^2$ to 300 C/dm$^2$. The temperature of the electrolytic aqueous solution is selected to be preferably in a range of from about 10° C. to about 70° C., more preferably, in a range of from 20° C. to 60° C.

Because the thus electrochemically roughened back surface is prevented from being swollen as seen in the case of an ink printing method or in the case of a compressively support sticking method, it is possible to prevent not only the adverse influence on the uniformity of the back surface itself but also adhesion to the photosensitive resin layer of another printing plate and elution of ink at the time of development. The roughness (Ra) of the back surface is selected to be preferably in a range of from about 0.2 μm to about 0.7 μm, more preferably, in a range of from 0.25 μm to 0.5 μm.

The back surface subjected to the aforementioned treatment may be further subjected to slight etching treatment. Note that the front surface being provided with the photosensitive resin layer is subjected to etching treatment after the electrochemical surface roughening treatment. Thus, in the case where etching treatments are necessary for both the front and back surfaces as described above, it is possible that the etching treatments are carried out separately but it is preferable that the etching treatments are carried out simultaneously.

Etching treatment is used for dissolving the surface of the aluminum support with an acidic or alkali aqueous solution. Examples of the acid include sulfuric acid, persulfuric acid, hydrofluoric acid, nitric acid, hydrochloric acid, etc. Examples of the alkali include sodium hydroxide, potassium hydroxide, sodium tertiary phosphate, potassium tertiary phosphate, sodium aluminate, sodium silicate, sodium carbonate, etc. Among these, the latter aqueous solutions are particularly preferable in the viewpoint of etching speed.

A part of the back surface of the aluminum support thus treated as described above is soft in itself so that it abrades easily. It is therefore preferable that an anodically oxidized film is formed in order to improve the strength of the back surface. The anodic oxidation can be carried out in accordance with a conventionally known method. For example, anodic oxidation can be carried out mainly by using a direct current and by using an aqueous or non-aqueous solution containing one member selected from sulfuric acid, phosphoric acid, oxalic acid, chromic acid and amidosulfonic acid or containing a mixture of two or more of these acids or containing aluminum ions in addition thereto as the electrolytic aqueous solution. Alternatively, anodic oxidation may be carried out by using an alternating current or by using a combination of direct and alternating currents. The electrolyte concentration, the temperature, the quantity of electricity and the quantity of the oxide coating film are preferably selected to be in a range of from 1% by weight to 80% by weight, in a range of from 5° C. to 70° C., in a range of from 10 C/dm$^2$ to 200 C/dm$^2$ and in a range of from 0.05 g/m$^2$ to 2.0 g/m$^2$, respectively.

The surfaces of the aluminum support thus obtained are further subjected to necessary surface treatment and then a conventionally known photosensitive resin layer is coated to the support. Thus, a planographic plate having a rough surface (design pattern) of an arbitrary shape embodied in its back surface can be produced.

In a planographic printing plate using a support obtained by the method of the present invention, the rough surface having a desired arbitrary shape on the back surface of the support has no bad influence on the photosensitive resin layer, and it is possible to maintain the high-grade characteristic of the design pattern and improve the added value thereof even when developing treatment is completed.

EXAMPLES

The present invention will be described below in more detail on the basis of examples thereof. In the following examples, "%" represents "% by weight" unless otherwise specified.

EXAMPLE 1

An aluminum support (240 mm×120 mm, JISA1050 material) with a thickness of 0.24 mm was immersed in an aqueous solution of 10% sodium hydroxide at 50° C. for 20 sec so that the aluminum support was cleaned by degreasing and etching. After the cleaning, the aluminum support was washed with water. Then, the aluminum support was neutralized with an aqueous solution of 25% sulfuric acid for 30sec and then washed with water.

Figure 2:
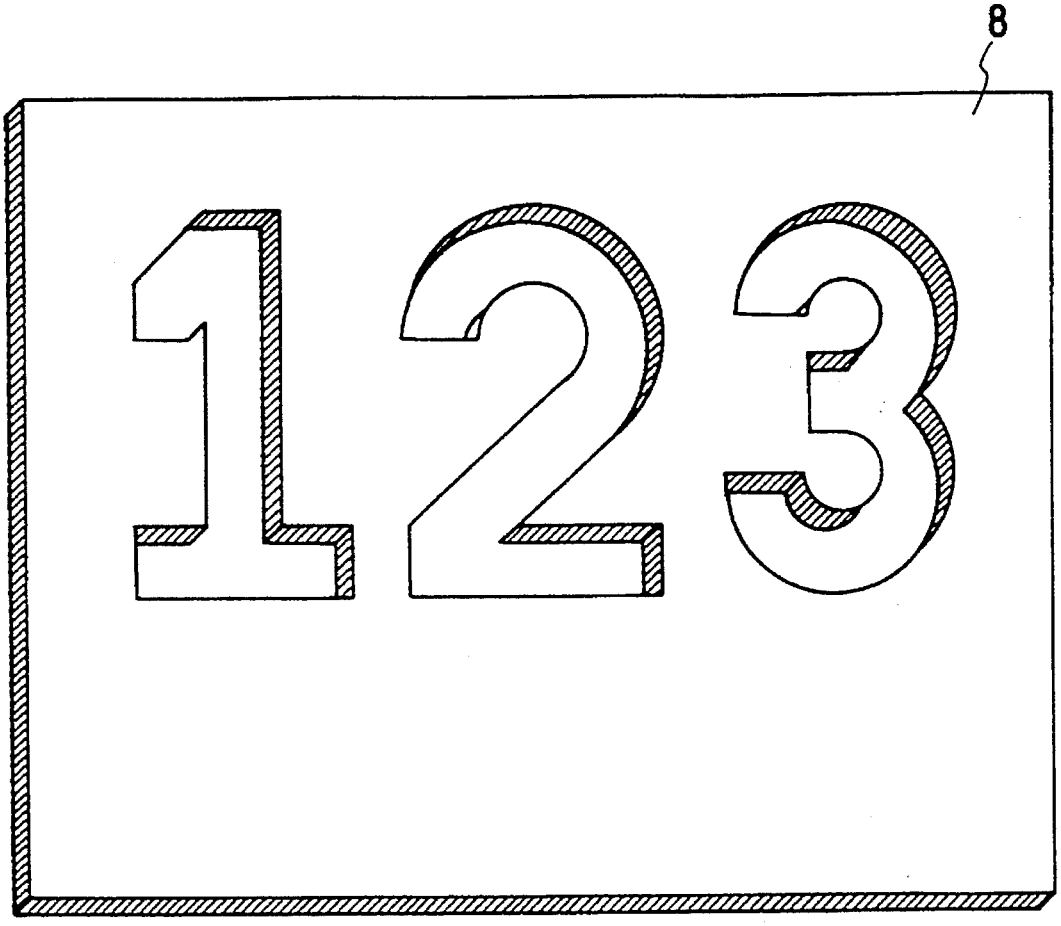
FIG. 2 is a perspective view of an embodiment of the shape of the masking plate used in the electrochemical roughening step of the support for the planographic printing plate according to the present invention.

Then, an electrolytic aqueous solution 2 which was prepared to contain the nitric acid concentration of 10 g/l and the aluminum ion concentration of 7 g/l and put into a stock tank 3 of an electrolytic treatment apparatus 1 as shown in FIG. 1, was fed to an electrolytic treatment cell 5 through pumps 4, 4 at a temperature of 55° C. In the electrolytic treatment cell 5, the aluminum plate 7 was arranged at a distance of 15 mm from an electrode 6 in the electrolytic solution so that the back surface of the aluminum support 7 was opposite to the electrode 6, and the aluminum support 7 was immersed in the electrolytic solution. In this occasion, a 1 mm-thick masking plate 8 (260 mm×140 mm) formed of an insulating material punched to provided openings with arbitrary shapes as shown in FIG. 2 was brought into close contact with the back surface of the aluminum support 7 so that the back surface of the aluminum support 7 was covered with the masking plate 8. A carbon plate (240 mm×120 mm) with a thickness of 50 mm was used as the electrode 6. Further, the electrolytic aqueous solution 2 was supplied from a blowout nozzle 9 toward the masking plate 8 at a flow rate of 50 m/min. The aqueous solution 2 was recycled to the tank 3 by flowing through solution discharge parts 12, 12. The electrode 6 and the aluminum support 7 were connected to an electric source 11 through a cable 10.

Further, a trapezoidal waveform AC with a frequency of 40 Hz and current density of 150 A/dm$^2$ was supplied from the electric source 11 for 2 sec to thereby roughen the aluminum support 7 electrochemically.

Then, the aluminum support 7 having a desired shape formed by roughening a portion of the back surface was washed with water, treated with an aqueous solution of 25% sulfuric acid for 20 sec and then anodically oxidized with an aqueous solution of 15% sulfuric acid in current density of 1 A/dm$^2$ for 30 sec.

Finally, the aluminum support 7 was washed with water and dried to thus prepare a support for planographic printing plate having an arbitrary design pattern realized in a part of one surface equivalent to the back surface by electrochemical roughening.

The surface roughness Ra of the design pattern portion thus embodied in one surface of the support for planographic printing plate was uniform in a range of from 0.25 μm to 0.30 μm, and the boundary between the design pattern portion and a not-roughened portion became very clear.

EXAMPLE 2

Treatment was carried out in the same condition as in Example 1, except that the electrolytic aqueous solution 2 in Example 1 was replaced by an electrolytic aqueous solution containing the hydrochloric acid concentration of 11.5 g/l and the aluminum ion concentration of 4.5 g/l. As a result, the roughened portion having a desired arbitrary shape embodied was the same as in Example 1.

What is claimed is:

1. A planographic printing plate, comprising:

a support having a front surface and a back surface; and a photosensitive resin layer provided on said front surface of said support, only a portion of said back surface being provided with electrolytically roughened indicia for identifying the printing plate.

2. The planographic printing plate according to claim 1, wherein no photosensitive resin layer is formed on said back surface.

3. The planographic printing plate according to claim 1, wherein said support is aluminum or an aluminum alloy.

4. The planographic printing plate according to claim 1, wherein one, or both, of the front and back surfaces are etched.

5. The planographic printing plate according to claim 4, wherein the back surface has an anodically oxidized film.

* * * * *